US006655182B2

(12) United States Patent
Mattsson

(10) Patent No.: US 6,655,182 B2
(45) Date of Patent: Dec. 2, 2003

(54) APPARATUS AND METHOD FOR RESHAPING TUBES

(75) Inventor: Lars-Åke Mattsson, Båstad (SE)

(73) Assignee: Lindab AB, Bastad (SE)

( * ) Notice: Subject to any disclaimer, the term of this patent is extended or adjusted under 35 U.S.C. 154(b) by 0 days.

(21) Appl. No.: 09/860,656

(22) Filed: May 18, 2001

(65) Prior Publication Data

US 2002/0170328 A1 Nov. 21, 2002

(51) Int. Cl.[7] ..... B21D 15/00

(52) U.S. Cl. ..... 72/110; 72/120; 72/370.23; 72/370.24

(58) Field of Search ..... 72/105, 106, 107, 72/110, 370.01, 370.04, 394, 396, 398, 370.23, 370.24, 370.25, 172, 175, 178, 179, 120, 121

(56) References Cited

U.S. PATENT DOCUMENTS

| | | | | |
|---|---|---|---|---|
| 1,930,562 A | * | 10/1933 | Krueger | 72/106 |
| 3,464,253 A | * | 9/1969 | Beyer et al. | 72/364 |
| 3,505,848 A | * | 4/1970 | Jones, Sr. | 72/110 |
| 3,623,349 A | * | 11/1971 | Hausler | 72/169 |
| 3,758,139 A | * | 9/1973 | Meserole | 285/332 |
| 3,837,203 A | * | 9/1974 | Ruth | 72/110 |
| 3,996,783 A | | 12/1976 | Meserole | |
| 4,008,596 A | | 2/1977 | Petrov et al. | |
| 4,312,208 A | * | 1/1982 | Schafer | 72/110 |
| 4,796,449 A | | 1/1989 | Berne | 72/9 |
| 5,193,376 A | * | 3/1993 | Weitl | 72/110 |
| 5,419,032 A | * | 5/1995 | Rytych | 72/106 |
| 6,000,261 A | | 12/1999 | Johnston | |
| 6,105,621 A | | 8/2000 | Primich | |

FOREIGN PATENT DOCUMENTS

| | | |
|---|---|---|
| DE | 37 29 868 C1 | 4/1988 |
| DE | 42 10 227 A1 | 9/1993 |
| EP | 0 919 302 A2 | 6/1999 |
| GB | 1425778 | 2/1976 |
| WO | WO 99/51371 | 10/1999 |

OTHER PUBLICATIONS

Roundo, Fully hydraulic three roll plate bending machine—Type PS–, 8–sheet product literature brochure of Roundo AB, Box 171, SE–281, 22 Hässleholm, Sweden, (undated).

Roundo, Quick Rolling Machine—Type PM–, 4–sheet product literature brochure of Roundo AB, Box 171, S–281, 22 Hässleholm, Sweden, (undated).

Roundo, 4–Roll fully hydraulic Plate Bending Rolls—Type PAS–, 6–sheet product literature brochure of Roundo AB, Box 171, S–281, 22 Hässleholm, Sweden, (undated).

Roundo, 4–Roll Plate Bending Machines—Type PASS, 2–sheet product literature brochure of Roundo AB, Box 171, S–281, 22 Hässleholm, Sweden, (undated).

Roundo, The Leading Manufacturer in Bending Roll Technology, 6–sheet product literature brochure of Roundo AB, Box 171, S–281, 22 Hässleholm, Sweden, (undated).

Roundo, Section Bending Machines—Type R–3–S to R–13–S–, 4–sheet product literature brochure of Roundo AB, Box 171, S–281, 22 Hässleholm, Sweden, (undated).

Ovalformer™ "Changing the Shape of the Future", 4–sheet product literature brochure with Ovalformer 1018 Specifications of Ovalformer LLC, 45 Loop Road, P.O. Box 793, Arden, NC 28704, (undated).

(List continued on next page.)

*Primary Examiner*—Ed Tolan
(74) *Attorney, Agent, or Firm*—Weingarten, Schurgin, Gagnebin & Lebovici LLP

(57) ABSTRACT

In a method of reshaping a tube, an apparatus is used which has a roller nip for rotating the tube, and a shaping roller assembly for altering the cross-section of the tube, for instance from round to oval.

25 Claims, 6 Drawing Sheets

OTHER PUBLICATIONS

Ovalformer™, Tubeformer SR 1250 1–sheet specification sheet/product literature of Ovalformer LLC, 45 Loop Road, Arden, NC 28704 and 1111 Gateway Service Park, Morristown, TN 37813, (undated).

Drossbach Machinery, Wickelfalzrohranlage SR 1250, 4–sheet product literature brochure of Drossbach GmbH & Co. KG, Max–Drossbach–Strasse 7, D–86641 Rain am Lech, Germany, Sep. 1999.

Ovalformer™ Spiralformer SF 10014 2–sheet specification/product literature of Ovalformer LLC, 45 Loop Road, Arden, NC 28704, (undated).

Ovalformer™ advertisement, published in *Snips*, A Journal of Constructive Help to the Sheet Metal, Air Conditioning, Warm Air Heating and Ventilating Contractor, Vol 69, Feb. 2000.

Catalogue 100, Hand Tools Machine Tools Equipment, published by Luna International and Luna Information, Luna Sverige AB, 441 80 Alingsås, Sweden, 1995, cover sheet and pp. 1710–1714.

* cited by examiner

APPARATUS AND METHOD FOR RESHAPING TUBES

TECHNICAL FIELD

The present invention relates to an apparatus and a method for reshaping tubes, in particular helically-wound lock-seam tubes for ventilation ductwork.

BACKGROUND ART

WO-A-99/51371 discloses an apparatus, referred to as ovalizer, for forming round ductwork to oval, that is an apparatus for altering the cross-section of a tube from round to oval. In particular, the tube is a spiral duct, also referred to as helically-wound tubing by the skilled person.

To achieve this reshaping of the tube, the apparatus has an elongate, horizontal duct forming assembly with two duct forming members vertically spaced from each other. The two duct forming members are connected to each other by power means configured to move the duct forming members to and from each other vertically.

A round tube to be reshaped is placed on the duct forming assembly and the power means (several hydraulic cylinders) is activated. As the distance between the duct forming members is increased, they press against the inner surface of the tube in two opposite locations and the tube is reshaped to an oval cross-section. Each duct forming member has a semi-circular head which presses against the inner surface of the tube.

This known technique has, however, some drawbacks which will be discussed below.

First, due to the pressing action against the inside of the tube, the tube wall is deformed and the material is stretched. This stretching may lead to ruptures and other defects in the tube wall.

Second, when the tube is a helically-wound lock-seam tube (normal case), the pressing action may lead to slippage or sliding in the lock seam, which in turn may produce tubes with different dimensions at each end. This makes it difficult to connect the tubes in a ventilation duct system.

Third, the semi-circular heads of the duct forming members have to be replaced for each diameter of the tube. The replacement operation is time-consuming, and several duct forming heads have to be kept in stock. This adds costs.

Fourth, the known apparatus has low flexibility since it can only be used for reshaping from round to oval.

Fifth, the deformed or reshaped tube (oval) tends to return to its original shape (round) due to stresses in the tube wall induced by the deformation.

Thus, there is a demand for an improved technique for reshaping of tubes.

As to background art, the so-called bending machines should be mentioned as well. A bending machine has a roller assembly to which a plate or sheet of metal is fed and formed to the desired shape, for instance to round cross-section. In a final step, the tube is closed by a longitudinal weld along the tube wall. However, these bending machines cannot be used for reshaping of a tube from, for instance, round to oval since the starting material always is a flat plate or sheet.

SUMMERY OF THE INVENTION

An object of the present invention is to provide a new and improved technique for reshaping of tubes, in particular helically-wound lock-seam tubes for ventilation ductwork, thereby avoiding or at least making the disadvantages discussed above less severe.

This object is now achieved by an apparatus for reshaping a tube, the tube having a wall with a periphery, an inner surface, an outer surface, a longitudinal axis and a cross-section having at least one radius of curvature, comprising:

- means configured to rotate the tube about the longitudinal axis in the apparatus;
- a first shaping roller parallel with the longitudinal axis of the tube and configured to engage the outer surface of the tube;
- a second shaping roller parallel with the longitudinal axis of the tube and configured to engage the inner surface of the tube; and
- means configured to move the first and second shaping rollers in relation to each other and in relation to the rotation means, in order to apply bending forces to the tube wall for altering said at least one radius of curvature and thereby reshaping the cross-section of the tube.

By this apparatus, the problems of the prior art technique are solved. Thanks to the ingenious arrangement of the shaping rollers and the means for moving these, it is very easy to reshape the tube. The material of the tube is not stretched since the circumference of the tube is not changed by the reshaping operation. Hence, no defects occur in the tube wall.

Furthermore, the apparatus can be used for reshaping a great number of tubes, from round to oval, from oval to round, etc. In principle, any cross-sectional shape of the tube is possible to achieve, as long as it has rounded corners, for instance triangular, rectangular, etc. Thus, the operation of the inventive apparatus is very flexible.

Another very important advantage is that the same apparatus can be used for all dimensions. No tube forming members have to be replaced when tubes of various dimensions are to be reshaped. The same roller arrangement can be used for all dimensions. Indeed, this is advantageous in comparison with the apparatus known from WO-A-99/51371 discussed by way of introduction.

In a preferred embodiment, the shaping rollers are configured to apply the bending forces in points of action which are spaced with respect to the periphery of the wall. As a result, a very smooth reshaping operation can be achieved. Preferably, the shaping rollers are configured to apply the bending forces along generatrices of the tube, which further enhances the reshaping operation.

It is preferred that the rotation means comprises a roller nip which has two opposite rollers configured to engage the tube wall in a nip and drivingly rotate the tube along its longitudinal axis. Such a roller nip provides for a secure and smooth rotational operation. Most preferably, the shaping rollers and the nip rollers are parallel in order to provide for simple control of the reshaping operation. Furthermore, the structure of the apparatus is very compact by this arrangement.

In a preferred embodiment, the apparatus comprises a frame with two opposite, spaced frame members between which the tube is disposed in operation. Each frame member has guiding means to which end portions of the shaping rollers are connected and which are configured to provide said movement of the shaping rollers. These guiding means in the frame members provide for a very distinct control of the reshaping movement of the shaping rollers. No disadvantageous inertia is involved.

Preferably, the guiding means are grooves provided in the respective frame members. Furthermore, it is preferred that actuator means, such as hydraulic cylinders, are mounted between the end portions of the shaping rollers and the frame members. Consequently, a distinct movement of the shaping rollers is achieved.

In one aspect of the invention, there is provided a roller unit for reshaping a tube having a cross-section and a longitudinal axis, comprising:

a first roller assembly configured to rotate the tube about the longitudinal axis, a second roller assembly configured to apply bending forces to the tube directed towards or away from the tube, thereby altering the cross-section of the tube.

The object is also achieved by a method of reshaping a tube, the tube having an inner surface, an outer surface, a longitudinal axis and a cross-section having at least one radius of curvature, comprising the steps of:

rotating the tube about the longitudinal axis; and applying bending forces on the inner and outer surfaces of the tube;

hereby altering said at least one radius of curvature for reshaping the cross-section of the tube.

The advantages of the method of the invention, and its preferred variants, are basically the same as discussed above in relation to the apparatus.

BRIEF DESCRIPTION OF THE DRAWINGS

The invention and its advantages will be further described in the following, reference being had to the accompanying schematic drawings which illustrate presently preferred embodiments by way of example.

DETAILED DESCRIPTION OF PREFERRED EMBODIMENTS

Figure 1:
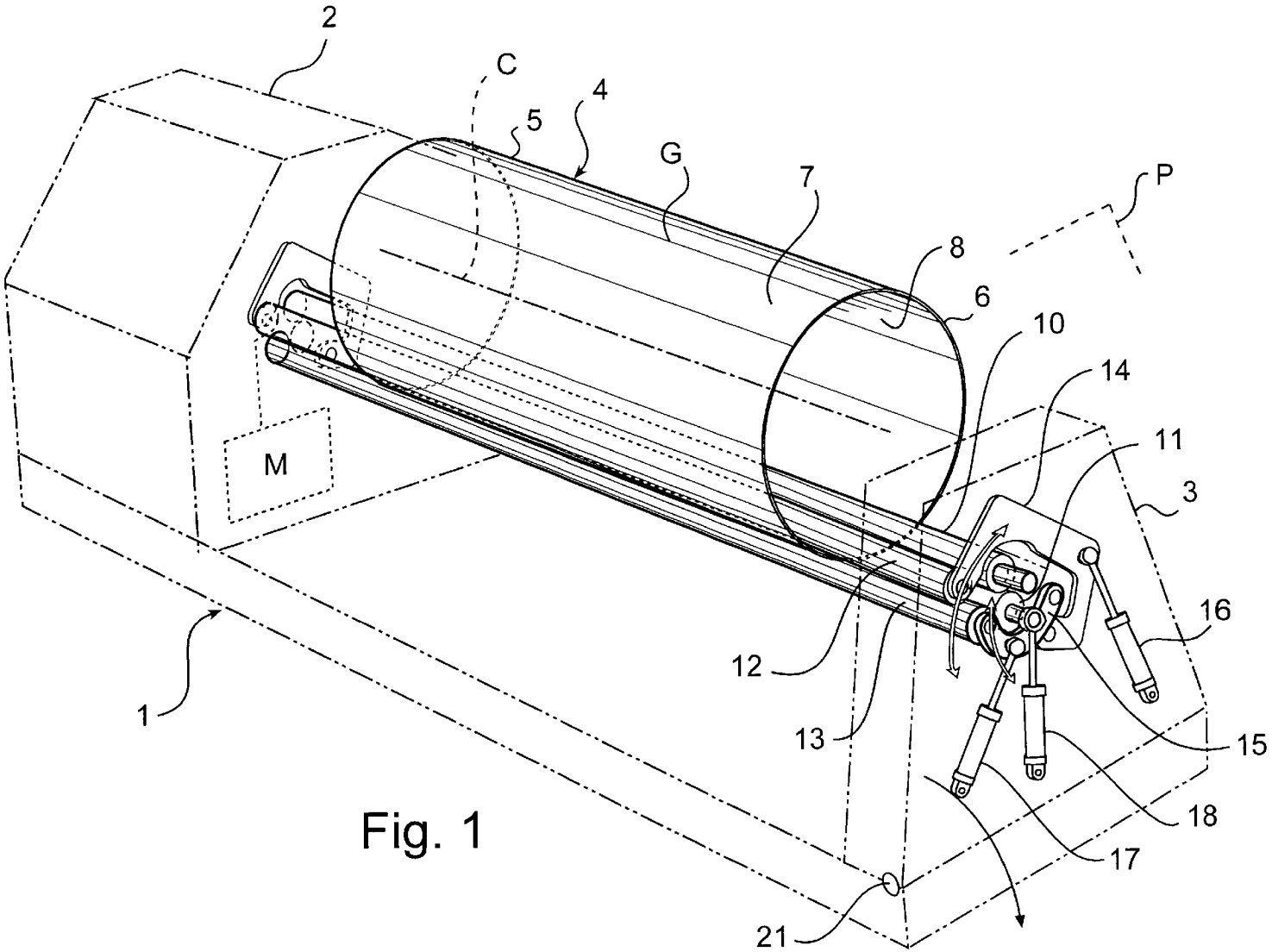
FIG. 1 is a perspective view of an apparatus according to a first embodiment of the invention.
Figure 3:
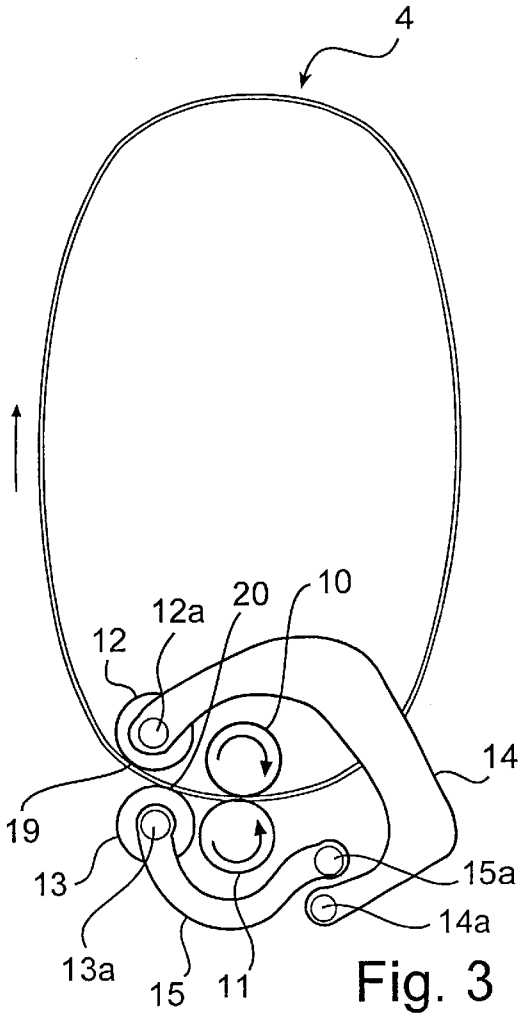
FIGS. 2–4 are side views of a reshaping mechanism of the apparatus shown in FIG. 1.
Figure 2:
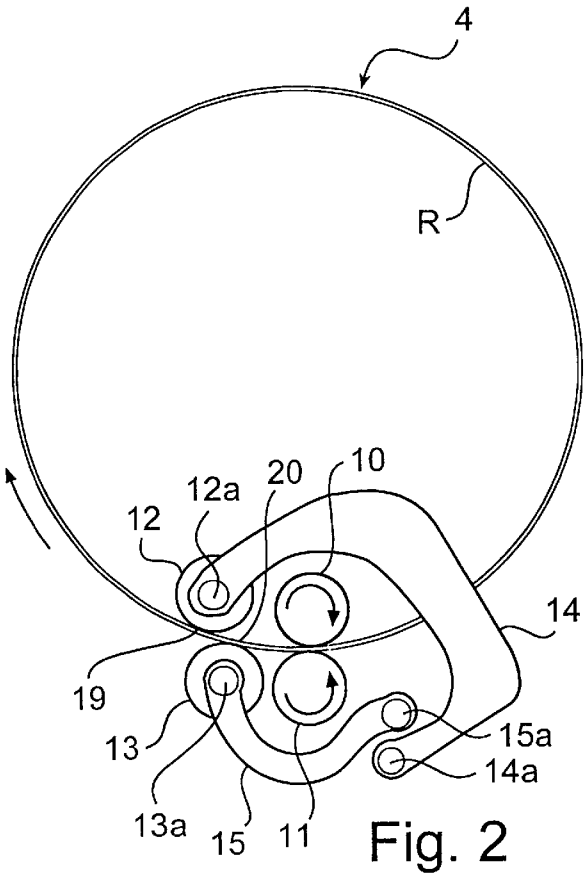
Figure 4:
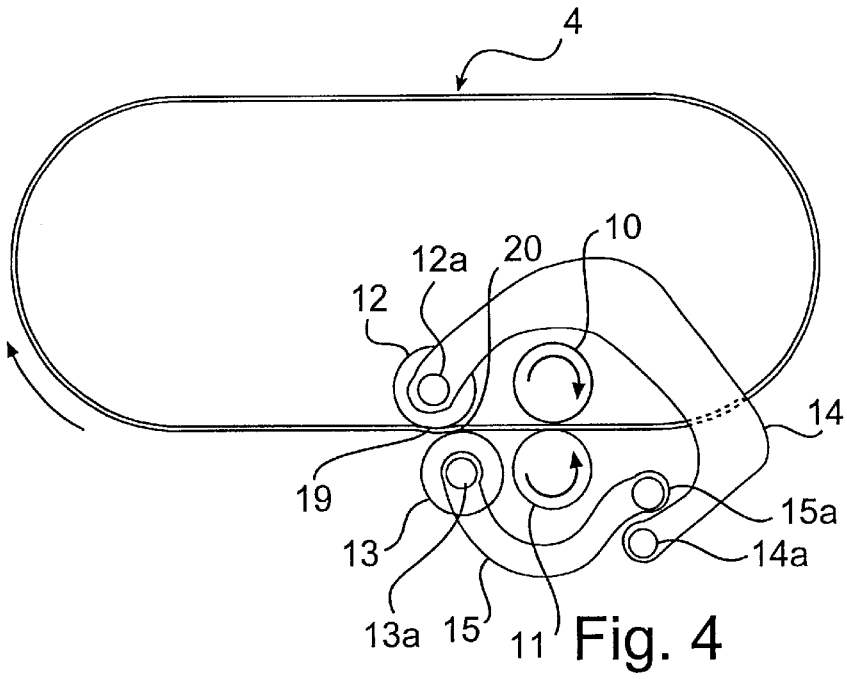

With reference to FIGS. 1–5, an apparatus according to a first embodiment of the invention comprises a frame 1 with two opposite, spaced frame members 2 and 3. A tube 4 having a wall 5, a periphery 6, an inner surface 7, an outer surface 8 and a longitudinal axis C is disposed between the frame members 2 and 3. A roller arrangement comprises two rotatable nip rollers 10, 11 and two rotatable shaping rollers 12, 13. The nip rollers 10, 11 provide means for drivingly rotating the tube 4 about its longitudinal axis C, and the shaping rollers 12, 13 provide for reshaping of the tube 4. This will be further described below.

The tube 4 shown in this example is a helically-wound lock-seam tube of sheet metal, suitable for ventilation ductwork.

All rollers 10–13 are parallel with each other and with the longitudinal axis C of the tube 4.

The nip rollers 10, 11 are rotated by a motor M mounted in the frame 1 (schematically shown in FIG. 1).

At each frame member 2, 3, there is a mounting assembly connecting the ends of the rollers 10–13 to the respective frame members. Only one mounting assembly is shown in FIG. 1. This assembly comprises two arms 14, 15 which are pivotally mounted on the frame member 3 (at 14*a*, 15*a*, respectively, see FIGS. 2–4). The arm 14 is connected to an end shaft portion 12*a* of the shaping roller 12 inside the tube 4, and the arm 15 is connected to an end shaft portion 13*a* of the shaping roller 13 outside the tube 4. The pivotal movements of the arms 14, 15 (see double arrows) are operated by actuator means, here shown as hydraulic cylinders 16, 17 mounted on the frame member 3.

The upper nip roller 10 inside the tube 4 is rotatably connected to the frame members 2, 3 at its two end shaft portions 10*a*. However, this nip roller 10 is "stationary" in the sense that it cannot be moved from its position in the frame 1. The lower nip roller 11, however, is vertically moveable with the aid of actuator means, here a hydraulic cylinder 18, mounted on the frame member 3.

The principles of the operation of the tube reshaping apparatus are illustrated in FIGS. 2–5. A tube 4 of circular cross-section is arranged in the apparatus and rotated clockwise by the nip rollers 10, 11 clamping the tube wall 5 in the nip. The inner or upper shaping roller 12 engages the inner surface 8 of the tube 4, whereas the outer or lower shaping roller 13 engages the outer surface of the tube 4. The shaping rollers 12, 13 are applied to the tube wall 5 along generatrices G of the tube 4.

By pivotal rotation of the arms 14 and 15, the shaping rollers 12, 13 apply bending forces to the tube wall 5 in points of action 19, 21 which are spaced with respect to the periphery 6 of the tube 4. Thus, the shaping rollers 12, 13 are moved in relation to each other and in relation to the nip rollers 10, 11. By this feature, the tube 4 can be formed to the intermediate cross-sectional shape shown in FIG. 3 and finally to the aimed-at oval cross-sectional shape shown in FIG. 4. In operation, the movements of the shaping rollers 12, 13 are precisely controlled by a computer (not shown). The mutual cooperative action between the two shaping rollers 12, 13 applying said bending forces to the tube wall 5 provides for smooth reshaping of the tube 4.

The first shaping roller 13 serves to decrease the radius R of curvature of the tube 4 whereas the second shaping roller 12 serves to increase the radius of curvature of the tube 4. The outer shaping roller 13 applies bending forces substantially directed to the center of the tube 4 whereas the inner shaping roller 12 applies bending forces directed away from the center of the tube 4. In operation, the two shaping rollers 12, 13 cooperate for providing the appropriate bending action.

Preferably, the arms 14, 15 are pivotable in a plane P which is perpendicular to the longitudinal axis C of the tube 4.

Figure 5:
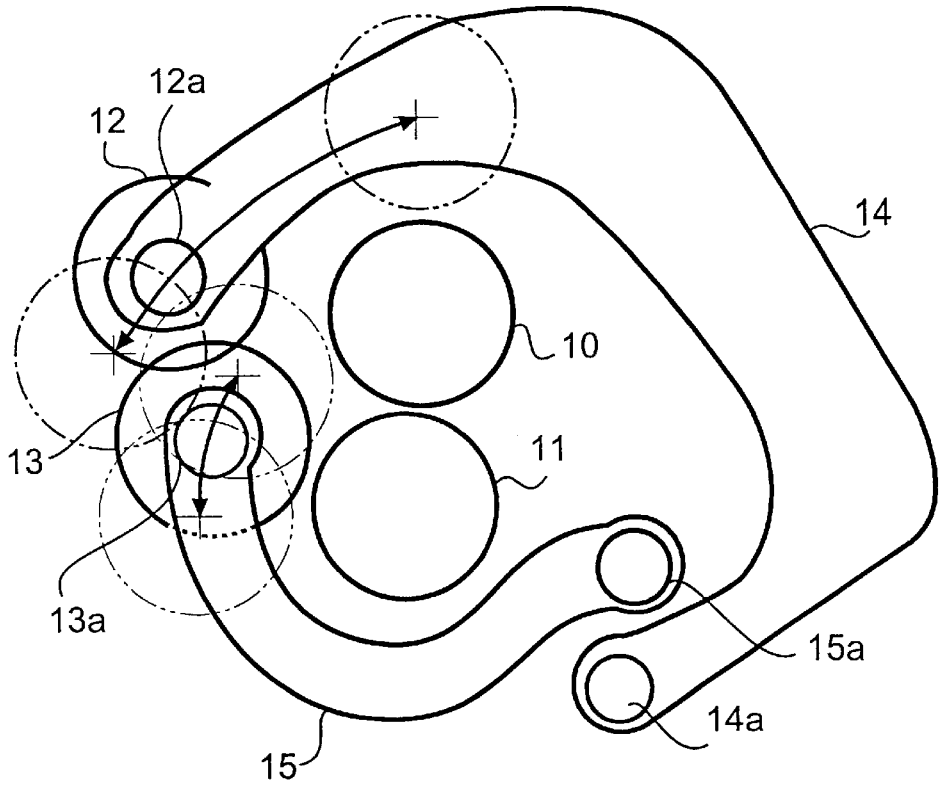
FIG. 5 shows various positions of rollers included in the reshaping mechanism.

The end positions of the shaping rollers 12 and 13, respectively, are shown by dotted lines in FIG. 5. Indeed, the end positions may vary depending on the aimed-at final shape of the tube 4.

In this example, it is shown how a round tube 4 is reshaped to an oval tube, that is altering the radius R of curvature of the tube. However, the apparatus can also be used for reshaping an oval tube to a round, etc. There are no specific limitations on the reshaping as to the initial or final cross-section of the tube.

As seen in FIG. 1, the frame member 3 is pivotably mounted at 21 so that this part of the frame 1 can be "opened" for feeding tubes into the apparatus, and removing reshaped tubes from the same. Of course, the inner rollers 10, 12 have to be disconnected from their mountings when a tube is to be fed into or removed from the apparatus.

Figure 8:
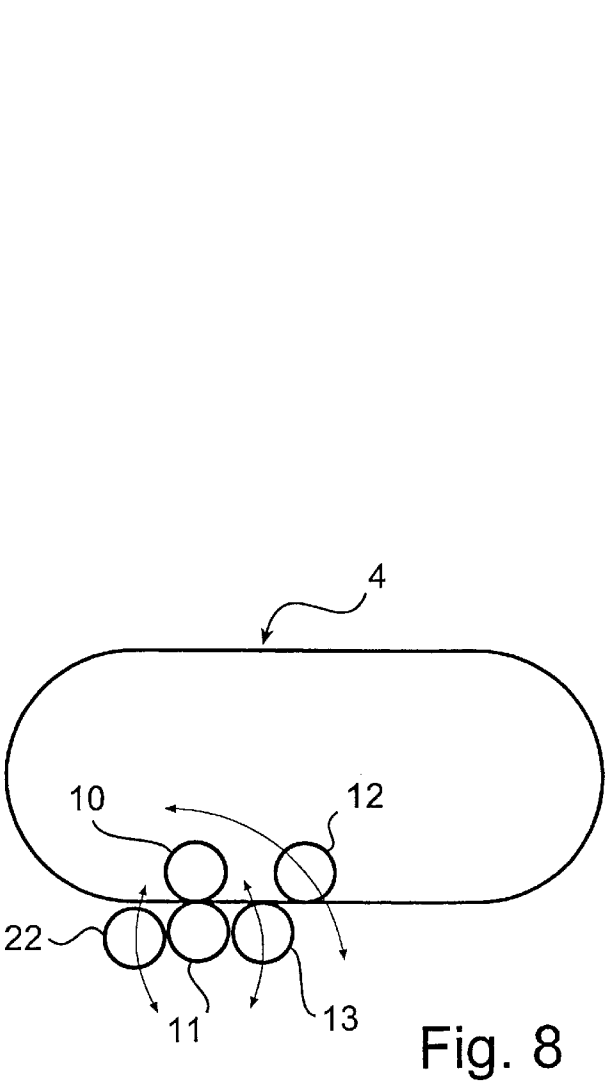
FIGS. 6–8 are side views of an alternative reshaping mechanism with an additional roller.
Figure 7:
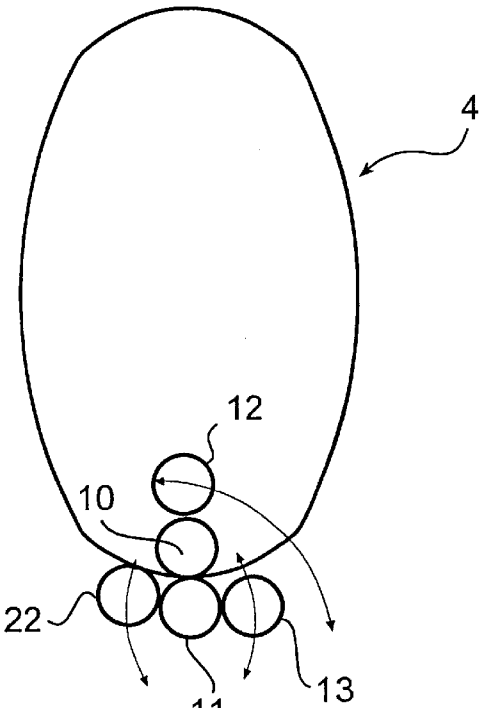
Figure 6:
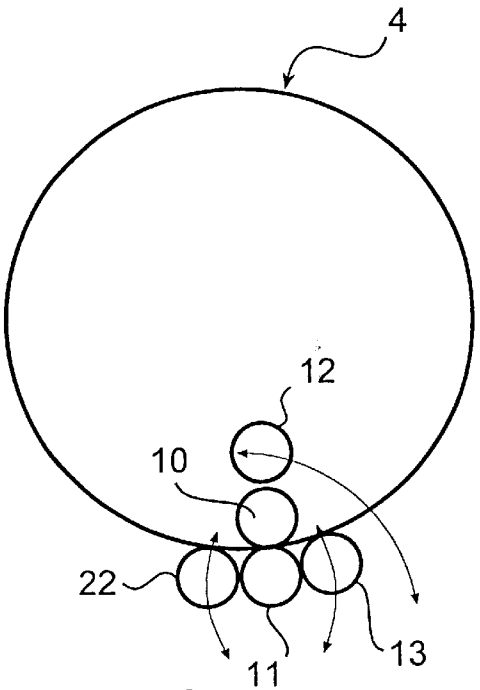

The number of rollers are not crucial to the reshaping. As an example, an alternative embodiment is shown in FIGS. 6–8. The rollers 10–13 are the same as in the embodiment described above, but an additional outer shaping roller 22 has been added. Since this additional shaping roller 22 and the outer shaping roller 13 are disposed on either side of the outer nip roller 10, a very smooth and effective reshaping operation is achieved. By raising and lowering these two shaping rollers 13 and 21 in a well defined sequence (controlled by a computer), a very favorable reshaping is accomplished.

Figure 9:
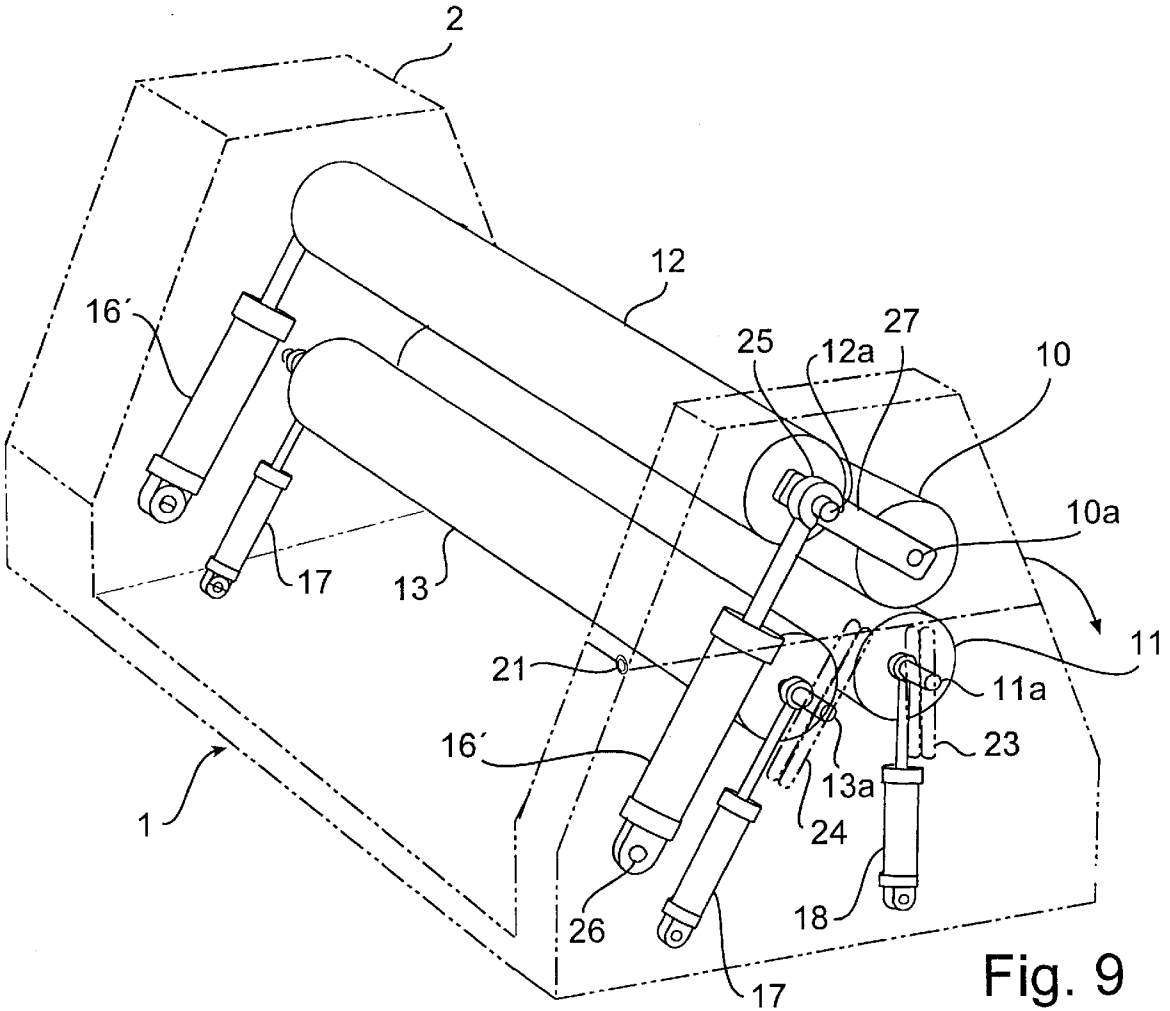
FIG. 9 is a perspective view of an apparatus according to a second embodiment of the invention.
Figure 10:
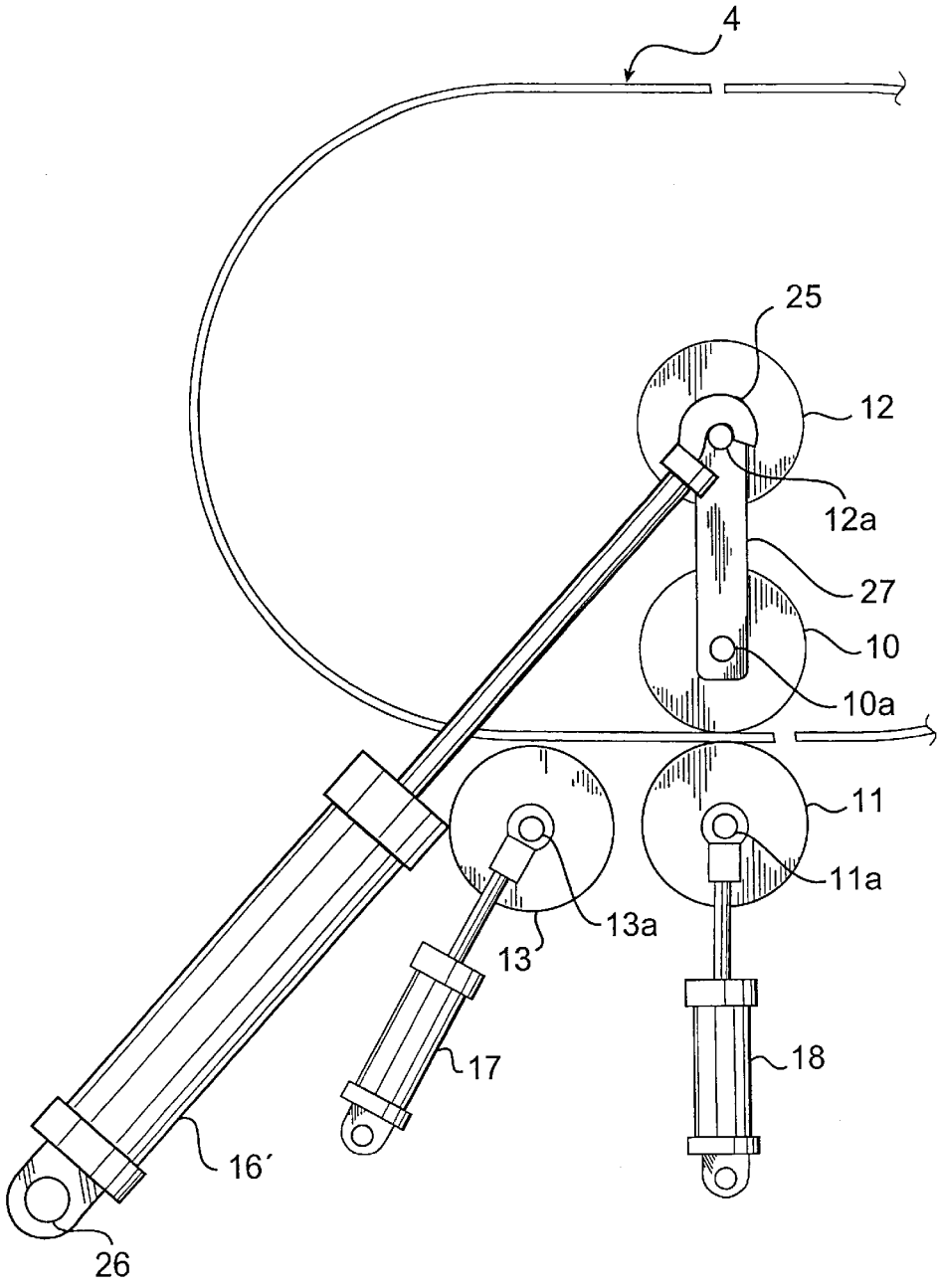
FIG. 10 is a side view of a reshaping mechanism of the apparatus shown in FIG. 9.

A second embodiment of the apparatus is shown in FIGS. 9–10. The main difference between this embodiment and the first embodiment concerns the means for mounting and moving the rollers 10–13. The apparatus of FIGS. 9–10 has two sets of mounting means, one at each end. In the following, only one set will be described.

The end shaft portion 11*a* of the outer nip roller 11 is received in an elongate recess or groove 23 in the frame member 3, and the end shaft portion 13*a* of the outer shaping roller 13 is received in an elongate recess or groove 24 in the frame member 3. These grooves 23, 24 constitute means for guiding the movement of the associated rollers 11 and 13 by actuator means, here (as in the first embodiment) hydraulic cylinders 18 and 17. The design of the grooves 23, 24 has to be calculated with respect to the desired movement and reshaping operation. Normally, the grooves 23, 24 are linear, but they could have a slight curvature as well (not shown).

As in the first embodiment, the outer or lower nip roller 11 is vertically moveable, whereas the inner or upper nip roller 10 is "stationary" (but of course rotatable). The inner and outer shaping rollers 12 and 13, respectively, are moveable in directions which form an angle with the vertical movement of the lower nip roller 11. It is seen in FIG. 9 that the two grooves 23 and 24 form an angle.

A slightly modified hydraulic cylinder 16' is connected to the end shaft portion 12*a* of the inner shaping roller 12. The difference with respect to the cylinder 16 shown in FIG. 1 is that the modified cylinder 16' is detachably connected to the end shaft portion 12*a* by means of a gripping member or claw 25. Thus, the cylinder 16' can be detached from the shaping roller 12 and swung to a vertical position about a pivot 26, allowing a change of tube. When a tube is to be fed into or removed from the roller nip 10, 11, the nip roller 11 is lowered by means of the cylinder 18, the gripping member 25 is detached from the end shaft portion 12*a* and the cylinder 16' is swung to its vertical position.

As in FIG. 1, the frame member 3 is pivotable at 21 so that this part of the frame can be "opened".

Preferably, the cylinders 16', 17 and 18 are disposed substantially in a common plane which is perpendicular to the longitudinal axis C of the tube 4. This results in a very compact and reliable structure.

For achieving a smooth movement of the inner shaping roller 12, its end shaft portion 12*a* is connected to the end shaft portion 10*a* by means of a link member 27. This link member 27 also serves to hold the upper nip roller 10 when a tube is replaced from the nip 10, 11.

As in the first embodiment, the first shaping roller 13 decreases the radius of curvature whereas the second shaping roller 12 increases the same. In FIG. 10, the inner shaping roller 12 is shown in its highest position above the nip rollers 10, 11, but the shaping roller 12 can be lowered in the direction of the cylinder 16' to a position in which it applies bending forces to the tube wall 5 in cooperation with the outer shaping roller 13. Then the cylinder 16' is pivoted about the pivot 26.

Very good practical results have been achieved by means of this apparatus. Helically-wound lock-seam tubes, to be used in ventilation duct systems, have been reshaped from round to oval without any experience of the drawbacks of the prior art technique discussed by way of introduction. A simple and improved method of reshaping tubes has been developed by the invention. In particular, it is favorable that the circumference of the tube remain unchanged during reshaping.

Finally, it should be emphasized that the invention is by no means restricted to the embodiments described herein, and several modifications are feasible within the spirit of the invention as it is defined in the appended claims. For instance, it should be mentioned that another number of rollers can be used than described here, and the invention is not limited to any particular type of tubes. Furthermore, other actuator means than hydraulic cylinders can be used, for instance pneumatic cylinders and the like. Alternative means for rotation, mounting and movement of the rollers can also be used.

What I claim and desire to secure by Letters Patent is:

1. An apparatus for reshaping a tube, said tube having a wall with a periphery, an inner surface, an outer surface, a longitudinal axis and a closed cross-section having at least one radius of curvature, comprising:

means configured to rotate said tube about said longitudinal axis in said apparatus;

a first shaping roller parallel with said longitudinal axis of said tube and configured to engage said outer surface of said tube;

a second shaping roller parallel with said longitudinal axis of said tube and configured to engage said inner surface of said tube; and means configured to move said first and second shaping rollers in relation to each other and in relation to said rotation means, in order to apply bending forces to said tube wall for altering said at least one radius of curvature and thereby reshaping said closed cross-section of said tube.

2. The apparatus of claim 1, wherein said shaping rollers and said moving means are configured to apply bending forces in points of action on said tube wall which are spaced with respect to said periphery of said tube wall.

3. The apparatus of claim 1, wherein said shaping rollers are configured to apply said bending forces along generatrices of said tube.

4. The apparatus of claim 1, wherein said rotation means comprises a roller nip assembly having two opposite rollers configured to engage said tube wall in a nip and drivingly rotate said tube about said longitudinal axis.

5. The apparatus of claim 4, wherein said shaping rollers are parallel with said rollers of said roller nip assembly.

6. The apparatus of claim 1, comprising a frame with two opposite, spaced frame members between which said tube is disposed in operation, each frame member having guiding means to which end portions of said shaping rollers are connected and which are configured to provide said movement of said shaping rollers.

7. The apparatus of claim 6, wherein said guiding means are grooves provided in said frame members, in which said end portions of said shaping rollers are received.

8. The apparatus of claim 6, wherein actuator means are mounted between said end portions of said shaping rollers and said frame members.

9. The apparatus of claim 8, wherein said actuator means are hydraulic cylinders.

10. The apparatus of claim 1, wherein said moving means comprises arms connected to end portions of said shaping rollers and pivotable in a plane substantially perpendicular to said longitudinal axis of said tube.

11. The apparatus of claim 10, wherein actuator means are mounted between said arms and said frame members of said apparatus.

12. The apparatus of claim 11, wherein said actuator means are hydraulic cylinders.

13. The apparatus of claim 1, comprising an additional shaping roller configured to engage said outer surface of said tube and spaced from said first shaping roller with respect to said periphery of said tube wall.

14. The apparatus of claim 13, wherein said additional shaping roller and said first shaping roller are disposed on either side of an outer nip roller included in said means for rotating said tube about said longitudinal axis.

15. The apparatus of claim 1, wherein the means configured to rotate said tube is further configured to rotate said tube without affecting said radius of curvature of said tube.

16. The apparatus of claim 1, wherein the means configured to rotate said tube is further configured to rotate said tube without applying reshaping forces to said tube.

17. A method of reshaping a tube, comprising the steps of:

providing a tube having an inner surface, an outer surface, a longitudinal axis and a closed cross-section having at least one radius of curvature;

rotating said tube about said longitudinal axis by rotation means;

engaging a first shaping roller with said outer surface of said tube;

engaging a second shaping roller with said inner surface of said tube; and moving said first and second shaping rollers in relation to each other and in relation to said rotation means to apply bending forces to said tube wall for altering said at least one radius of curvature and thereby reshaping said closed cross-section of said tube.

18. The method of claim 17, wherein said tube has a wall with a periphery and said bending forces are applied in points of action on said tube wall, said points of action being spaced with respect to said periphery of said tube wall.

19. The method of claim 18, wherein said points of action of said bending forces are moved along said periphery of said tube wall during said reshaping of said tube.

20. The method of claim 17, wherein said bending forces are applied along generatrices of said tube.

21. The method of claim 17, further comprising rotating said tube without applying reshaping forces by said rotation means.

22. The method of claim 17, further comprising rotating said tube without affecting said radius of curvature of said tube by said rotation means.

23. A roller unit for reshaping a tube having a closed cross-section and a longitudinal axis, comprising:

a first roller assembly configured to rotate said tube about said longitudinal axis, a second roller assembly configured to apply bending forces to said tube directed towards or away. from said tube, thereby altering said closed cross-section of said tube, said second roller assembly movable in relation to said first roller assembly.

24. A tube reshaped by means of the method of claim 17.

25. A method of reshaping a tube having a longitudinal axis and a closed cross-section, comprising:

providing a tube having a longitudinal axis and a closed cross-section;

providing a roller arrangement for reshaping said tube, at least one shaping roller being disposed inside said tube and at least one shaping roller being disposed outside said tube;

rotating said tube about said longitudinal axis;

moving said shaping rollers along inner and outer surfaces of said tube to apply bending forces to said tube independently of said rotating step to thereby alter at least one radius of curvature of said tube to reshape said cross-section of said tube.

* * * * *